United States Patent [19]

Bronikowski et al.

[11] 3,946,351

[45] Mar. 23, 1976

[54] SHIELDED FUSE ASSEMBLY

[75] Inventors: Raymond J. Bronikowski; James R. Marek, both of South Milwaukee; John L. Barger, Greendale, all of Wis.

[73] Assignee: McGraw-Edison Company, Elgin, Ill.

[22] Filed: Feb. 28, 1975

[21] Appl. No.: 554,131

[52] U.S. Cl. ..... 337/224; 174/73 R; 337/199; 337/203

[51] Int. Cl.[2] ..... H01H 85/00

[58] Field of Search ..... 337/224, 222, 199, 201, 337/202, 203, 186, 249, 250; 174/73 R; 339/143 R, 143 C

[56] References Cited

UNITED STATES PATENTS

| | | | |
|---|---|---|---|
| 3,028,568 | 4/1962 | Camilli | 174/73 R |
| 3,588,607 | 6/1971 | Ristuccia | 337/201 |
| 3,686,604 | 8/1972 | Link et al. | 337/224 |
| 3,721,745 | 3/1973 | Parks et al. | 174/73 R |
| 3,818,407 | 6/1974 | Edgerton | 337/224 |

*Primary Examiner*—Harold Broome

[57] ABSTRACT

Two housing halves are joined to form a housing surrounding an electrical fuse, a sealing gasket being provided at the joint between the housing halves. A corona shield is embedded wholly within each housing half, each shield terminating on its respective side of the gasket so that the ends thereof are closely adjacent but yet spaced apart with a portion of the gasket therebetween. Each shield is electrically connected to a respective end of the fuse. The gasket has an inner cylindrical wall provided with spaced ribs. The cylindrical wall closely engages the fuse within the housing and small elongated openings are defined along both sides of each rib. A vent assembly in one of the housing halves selectively opens and closes the housing interior to the ambient dependent upon the internal housing pressure.

16 Claims, 8 Drawing Figures

SHIELDED FUSE ASSEMBLY

BACKGROUND OF THE INVENTION

This invention relates to electrical devices such as fuses and lightning arrestors and, more particularly, to enclosures for such electrical devices which are particularly well suited to an underground, or generally submersible, installation, or similar installations where the conditions ambient the enclosed electrical device may vary.

In its on-line mode of operation the enclosed fuse, or lightning arrester, is at line potential and the voltage stress in the area of the fuse must be controlled to minimize the occurrence of corona and it well known deleterious effects. Corona shields carried by a housing enclosing a fuse have been used in the past, examples of such arrangements can be found in U.S. Pat. Nos. 3,588,607, 3,686,604, and 3,818,407. Similarly, corona shields carried by the actual fuse housing have been used, and examples can be found in U.S. Pat. Nos. 2,593,426 and 2,844,691. The structures shown in these patents are only typical and are not to be considered exhaustive of the prior art arrangements which have been proposed.

This invention is concerned with this problem of controlling voltage stress to minimize the occurrence of corona and has as one of its general objects the provision of an improved corona shield arrangement for an enclosed electrical device such as a fuse or lightning arrester.

An additional object is to optimize corona prevention while reducing the overall size of the enclosed electrical device and while remaining consistent with design parameters for an underground, or generally submersible, electrical installation.

Another specific object of this invention is to insure that all electrical stress occurs across the insulation material of the factory molded housing and not across air spaces normally occuring in the chamber defined by the enclosure.

It is believed that this invention will find perhaps its widest and most immediate application in connection with enclosed non-expulsion type fuses such as sand current-limiting fuses and vacuum fuses. Therefore, it will be discussed in that enviroment but should not be interpreted as being so limited in its application; as already stated, it may be used with lightning arresters as well as other electrical circuit interrupter devices. In such applications, deposits due to ambient conditions may occur naturally on the interior of the housing enclosure as the unit stands on line and, even in such applications, some gases may evolve during interruption even though such fuses are basically non-expulsion. Such gas evolution may contribute to the deposits. It is recognized that these deposits can form a conductive path between terminals and should be avoided. Also, internal pressures sufficient to rupture the enclosure are to be avoided. This invention is also concerned with these problems and further objects of this invention are to provide, in the housing interior, an effective barrier to the completion of this conductive path and to prevent excessive internal pressure buildup.

SUMMARY OF THE INVENTION

For the achievement of these and other objects, this invention proposes to embed two shields of conductive material in the enclosure housing the electrical device, e.g. a fuse, so that the shields are completely surrounded by the molded insulation material of the housing. The shields are electrically connected one to each of the terminals of the fuse. The shields extend along respective lengths of the fuse and terminate such that their ends are spaced so as not to provide a complete electrical path between the fuse terminals when interruption occurs but are close enough that flux lines fringe between the spaced ends without appreciable penetration into the interior housing chamber in which the fuse is located thereby establishing a shielding bridge for effective corona control.

Preferably, the shields are cylindrical and completely surround their respective lengths of fuse.

The housing is preferably split along a radial plane between the spaced ends of the shields. A gasket is provided at the joint between the split housing portions and with a part thereof positioned axially between the spaced shield ends. This provides an adequate dielectric, and better control over that dielectric, between the spaced ends of the shields, again to enhance corona control.

The gasket performs an additional function in that it includes an inner generally cylindrical wall which closely engages the outer wall of the fuse, or other electrical device, in the housing. The gasket provides an effective anti-tracking barrier preventing the completion of a conductive path along the chamber walls between the spaced terminals of the fuse, in that the gasket itself provides a physical interruption at the interior chamber wall preventing the complete deposit of contaminants from one terminal to the other along that interior wall.

Although use with non-expulsion type interrupting devices is contemplated, it is possible that some gases may be evolved during the interruption process of those devices. To relieve pressures which may otherwise be built up during expulsion of such gases and to prevent an excessive pressure buildup, the gasket is adapted to permit the passage of gases from one side of the gasket to the other. This will equalize the pressure on both sides of the gasket preventing buildup on one side sufficient to rupture the enclosure or cause other damage. This is accomplished by providing small ribs on the interior wall of the cylindrical portion of the gasket so that, although the gasket closely engages the major portion of the outer fuse housing, small elongated openings are provided along that housing on each side of the rib. These openings are large enough to permit gas passage from one side of the gasket to the other but do not readily accept contaminant deposits. Should moisture attempt to pass through these openings, that moisture is kept to a small amount because of the opening size and will generally be vaporized by the heat generated by the fuse, particularly where the fuse is a current limiting sand fuse and the gasket engages the sand fuse around its center area in which interruption occurs. That area is a point of extremely high temperature upon interruption and the evaporation will occur due to that high temperature.

Beyond equalizing pressures, a vent is provided from the interior chamber of the housing to the ambient. The vent selectively opens the interior chamber to the ambient to exhaust pressures and reseals to prevent entrance of contaminants, all dependent upon the pressure within the enclosure.

In practice, the outer surface of the housing is provided with a conventional electrically conductive coating which is generally intended to be at ground potential. With the embedded shield as just described and while the fuse is in its on-line mode and before interruption, electrical stress occurs between the shields and the outer conductive coating. This invention places the electrical stress across the molded factory insulation and completely eliminates the air space in the interior chamber between the fuse structure and the interior chamber wall from the dielectric system. This allows the overall enclosure to be smaller in diameter and also gives far better control over the dielectric necessary to withstand the electrical stress from the expected line potential without the occurrence of corona.

When the fuse operates, one of the shields will be at line potential and the other shield is generally at ground potential, but here again any electrical stress is either between the shields themselves or the one shield and the conductive coating on the outside of the enclosure and, therefore, is always across factory controlled insulation.

Other objects and advantages will be pointed out in, or be apparent from, the specification and claims, as will obvious modifications of the embodiments shown in the drawings, in which:

DESCRIPTION OF THE PREFERRED EMBODIMENTS

This invention has application to enclosed, non-expulsion fuses such as sand fuses and vacuum fuses and can also be used to enclose lightning arresters but is not limited to such electrical circuit elements. For convenience, and since the invention will probably find its widest and most immediate application in the area of enclosed, non-expulsion fuses, it will be described in that environment.

Figure 2:
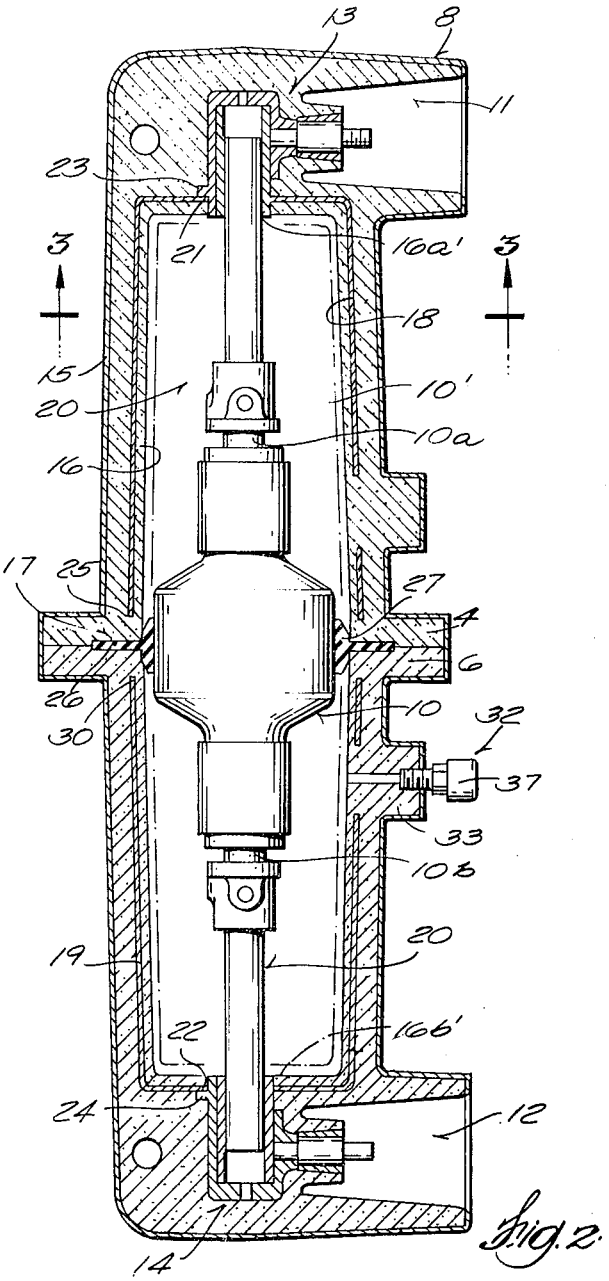
FIG. 2 is an axial section through the housing and illustrating the interior structure of the housing with a fuse supported therein.
Figure 1:
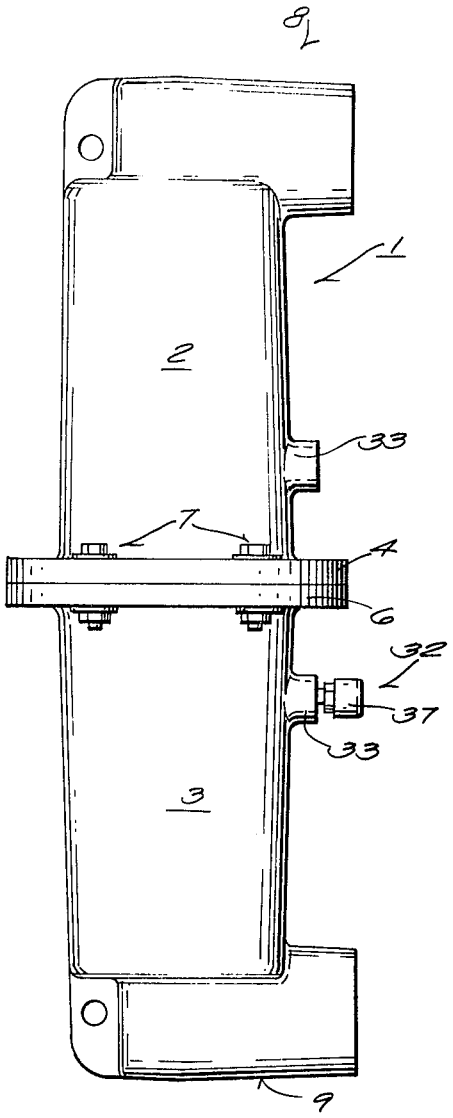
FIG. 1 is a side elevation of a housing embodying this invention.
Figure 3:
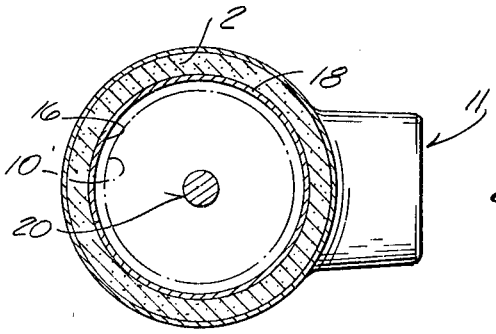
FIG. 3 is a section taken generally along line 3—3 in FIG. 2.

With particular reference to FIGS. 1 and 2, a molded fuse housing 1 is formed by housing halves 2 and 3. The fuse housing is molded from a suitable electrical insulating material which, in addition to its electrical insulating properties, also possesses good non-tracking characteristics. Such a material is available commercially under the name "Rosite."

The housing halves are joined at connecting flanges 4 and 6, the flanges abutting along a generally radial plane. Attachment of the connection flanges is made through nut and bolt sets 7 in aligned openings (not shown) in the abutting flanges. With housing 1 split along a generally radial plane, the halves 2 and 3 can be rotated relative to each other to vary their relative orientation to accommodate different location arrangements. Also, being split radially facilitates the assembly of a fuse into the housing.

Elbows 8 and 9 are provided at the opposite ends of the fuse housing and conventional bushing wells 11 and 12 are molded in the elbows. Conductive terminal assemblies 13 and 14 are provided in the elbows, the terminal assemblies communicating with the inner chamber 16 of the housing and also with the spaces defined in bushing wells 11 and 12. A vacuum fuse 10 is supported centrally within chamber 16. (The positioning of a conventional sand fuse 10′ in the chamber 16 is illustrated by the phantom lines in FIG. 2.) Where the axial length of the vacuum fuse is less than the distance between terminal means 13 and 14 through chamber 16, connection adapters 20 are provided within the chamber to make the electrical connection between the end terminals 10*a* and 10*b* of the vacuum fuse and the terminal means 13 and 14. (As can be seen in FIG. 2, the sand fuse has terminals 16*a*′ and 16*b*′ which engage directly in the terminal means 13 and 14.)

The interior structure of both the vacuum fuse and the sand fuse is conventional and the details thereof are not necessary to a complete understanding of this invention and therefore have not been illustrated and will not be described.

A conductive coating 15 is provided over the outer surface of housing 1 and is generally intended to be at ground potential when the enclosed fuse assembly (fuse 10 and housing 1) is connected on-line. Again, this is a conventional connection and is not necessary to a complete understanding of this invention so it has not been further illustrated nor will it be further described.

Gasket 17, preferably made of silicone rubber, is positioned at the joint between flanges 4 and 6. The gasket seals the joint against entrance of moisture into chamber 16 and also performs an electrical function which will be described hereinafter.

Conductive shields 18 and 19 are embedded in housing halves 2 and 3, respectively. The housing is generally circular in transverse cross section and consistent with that shape the axially extending portion of shields 18 and 19 are generally cylindrical. Each shield includes a radially disposed end 21 and 22. These ends 21 and 22 make electrical contact with shoulders 23 and 24 on terminals 13 and 14, respectively. The ends 25 and 30 of the shields terminate in axial spaced relation, i.e., axially spaced relative to the longitudinal axis of housing 1.

Gasket 17 includes a generally annular flange 26 which, as can be seen in FIG. 2, extends into the space between shield ends 25 and 30.

When the fuse is in its on-line mode of operation, i.e., has not interrupted, an electric circuit is completed from terminal 13 through the fuse assembly to terminal means 14. Shields 18 and 19 are connected to terminal means 13 and 14 and are at the same potential as the opposite ends of the fuse structure. With the fuse on-line, there is virtually little voltage drop across the fuse and correspondingly little voltage across the shields. In the on-line mode the voltage stress would occur from the fuse to the exterior surface 15; however, with the shields 18 and 19 being at the same potential as the fuse structure, there is virtually no voltage stress between the shields and the fuse and, correspondingly, across the air space between the fuse and the inner walls of chamber 16. All voltage stress occurs between shields 18 and 19 and the outer housing surface 15 so that the voltage stress is across the factory molded insulation which can be predesigned to adequately withstand the expected voltage stress without the occurrence of corona. This completely eliminates the air space from the dielectric of the fuse assembly affording more effective control over the occurrence of corona and, moreover, permitting the housing to have a minimum diameter since the normally occurring air space does not have to be calculated into the dielectric necessary to withstand the voltage stress without the occurrence of corona, and can be held to an absolute minimum. Again, the dielectric being provided solely by the factory molded insulation between the conductive shields and the outer wall 15 of the housing affords more precise design and a dielectric which is virtually free of any variance over the life of the housed fuse.

Ends 25 and 30 of the conductive shield are spaced apart so as not to establish a closed circuit between terminals 13 and 14 through the conductive shields. Thus, when the fuse operates and interrupts the electrical circuit through the assembly, line current will not find a path through the electrical shield and reliable circuit interruption is achieved. The spacing between ends 25 and 30 is selected such that they will be close enough to permit fringing of the dielectric flux lines between those opposed ends without appreciable penetration into chamber 16 which could result in creation of corona. This fringing occurs while the fuse is still in its on-line mode and cooperates in providing a shielding bridge through the axial space between the ends.

Using the Rosite type material for the housing, a spacing between ends 25 and 30 in the range of ¼ to 2 inches has given satisfactory results both from the standpoint of providing the desired fringing effect and in maintaining an open circuit in the interrupted mode of the fuse.

After the fuse interrupts, and assuming that terminal means 13 is connected to the line and terminal means 14 is connected to the equipment to be protected, shield 18 will be at line potential and shield 19 will generally be at ground potential. In this mode, all electrical stress will now occur between shields 18 and 19 and between shield 18 and the outside of the housing 1. Again, the voltage stress occurs across factory molded insulation so that adequate control over occurrence of corona is achieved even after interruption even though occurrence of corona in that mode is not particularly critical. It is not critical because any condition will be temporary as the blown fuse will be replaced by a new fuse as soon as the line is re-established.

The positioning of flange 26 of the gasket between the spaced ends 25 and 30 of the shield is a further factor in enhancing protection against the occurrence of corona. If only a butt joint between the flanges was provided without the gasket being present between the spaced ends, the butt joint would constitute an air space in the dielectric between the shield ends. The breakdown voltage for an air space is generally in the neighborhood of 70 V/mil. With that relatively low voltage breakdown strength, corona could occur. By positioning a portion of the gasket in the joint, the breakdown is considerably increased. With the silicone rubber gasket positioned as illustrated, the voltage breakdown is approximately 300–400 V/mil and adequately reduces the possibility of the occurrence of corona in that area before and after interruption. In the on-line mode the gasket contributes to the provision of the desired fringing effect discussed above.

As was previously mentioned, the Rosite material has anti-tracking properties to minimize the possibility of a conductive path forming on the inner walls of chamber 16 between the spaced terminal means 13 and 14. Gasket 17 has an additional function in that it also provides a physical interruption in any path between terminal means 13 and 14 to prevent completion of a conductive path therebetween by any deposited contaminants. Specifically, the gasket includes central body 27 which closely engages around the outer central body 25 of fuse 10. As illustrated the central body is compressed between the walls of chambers 16 and fuse body 25 providing a substantial sealed area at that point which cannot receive contaminants thereby interrupting any direct path between the terminal means. At this point, it should be appreciated that should a vacuum fuse or any fuse of lesser diameter be used, the gaskets with inner diameters reduced accordingly are used and the radial extension of the annular flange 26 is increased. Although a tight seal is not provided between the central body and the walls of chamber 16 in this variation, the annular flange still provides a physical barrier between the housing halves preventing the buildup of the contaminant conductive path.

Figure 4:
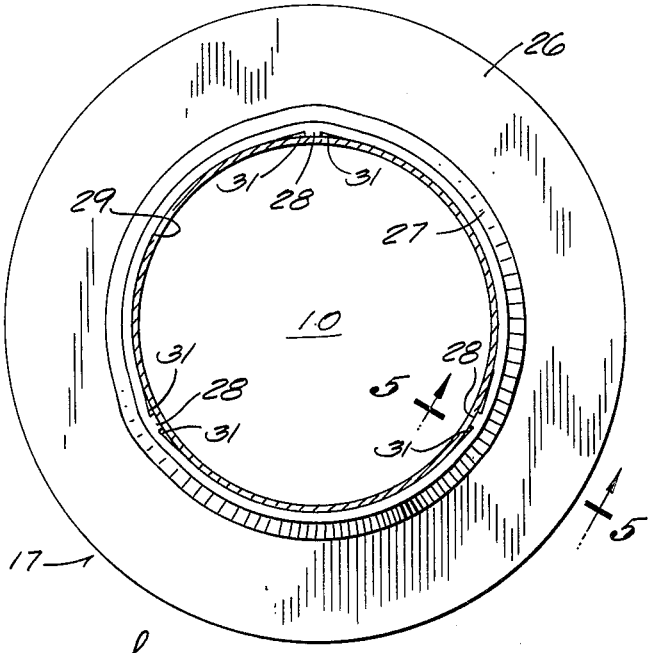
FIG. 4 is a top plan view of the gasket as it engages the outer walls of the fuse supported in the housing.
Figure 5:
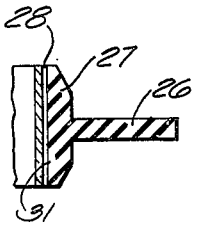
FIG. 5 is a section view taken generally along line 5—5 of FIG. 4.
Figure 6:
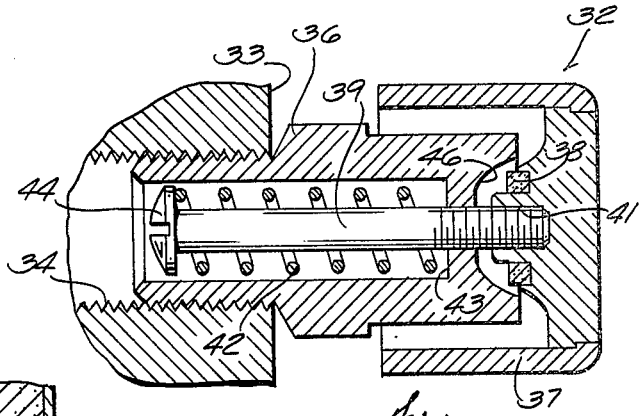
FIG. 6 is a section view of the vent assembly.

The pressures in chamber 16 on opposite sides of the gasket may experience increases in the on-line mode and during interruption mode of the fuse. It is desirable that these pressures not be allowed to increase to a point sufficient to rupture the housing 1 or cause internal damage. To this end, a plurality of spaced ribs 28, in this case three, are provided on the inner wall 29 of the gasket body. As can be seen in FIG. 4, although the major portion of the inner wall 29 closely engages the fuse, openings 31 are provided on each side of the rib. These openings extend axially relative to the longitudinal axis of the housing and are relatively small so that they will readily pass gases from one side of the gasket to the other but will not readily accept contaminants. The gases can then flow freely to equalize pressures and prevent an excessive pressure buildup on one side or the other of the gasket.

It should also be noted, that should moisture occur within the fuse housing and attempt to pass through the openings 31, only a small amount of moisture at any given time can enter the openings because of the opening size. This relatively small amount of moisture will generally be evaporated by heat generated in the fuse, particularly when the fuse interrupts as the central body portion 25 experiences an intensive heat buildup upon interruption.

In order to further insure against buildup of excessive pressures in chamber 16, a vent 32 is provided in the housing. Vent 32 includes a body 36 which threads into opening 34 in boss 33 in housing half 3. A similar boss 33 can be seen on housing half 2, this boss is not provided with an opening and a vent. It merely is present because the same mold is utilized in molding both housing halves. A second vent assembly 32 can be provided at that boss if desired.

Vent 32 includes a cap 37 which carries a sealing ring 38. Post 44 threads into an opening 41 in cap 37. Compression spring 42 is seated between the head of post 44 and an inner shoulder 43 in vent body 36. The compression spring normally biases sealing ring 38 into engagement with seat 43 to seal the interior chamber 16 against entry of contaminants from the ambient. Pressure buildup within chamber 16 above a preselected value will act on cap 37 and automatically lift sealing ring 38 from its seat 43 venting the built up gases to the atmosphere. When the pressure falls below the preselected level, the cap and sealing ring automatically reseat sealing the interior chamber 16 from ambient contaminants.

Figure 7:
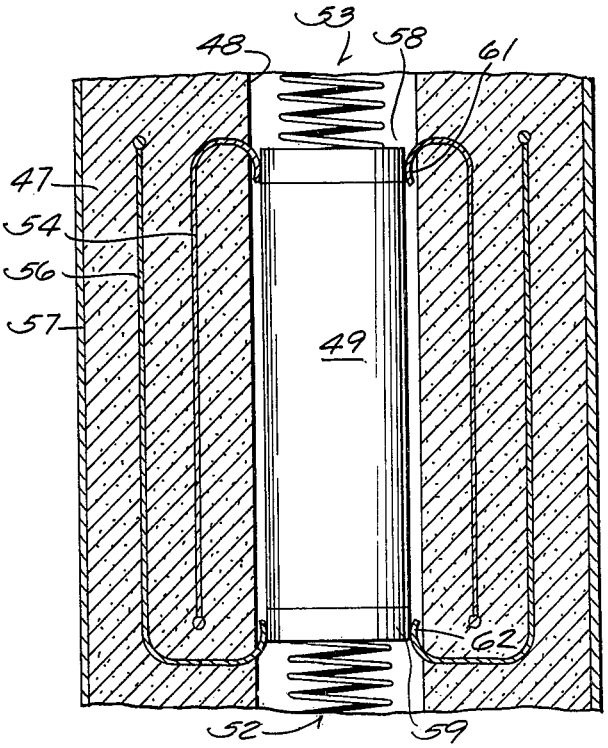
FIG. 7 is an axial section view through an alternative embodiment of this invention.
Figure 8:
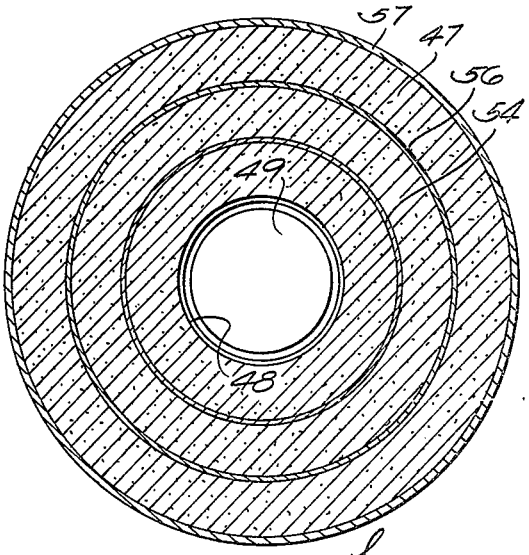
FIG. 8 is a radial section through an alternative embodiment of this invention.

With reference to FIG. 7, an alternative arrangement of the conductive shields has been illustrated. In this embodiment, the fuse 49 again is positioned within a chamber 48 in a housing 47 of electrical insulating material, e.g., Rosite. Fuse 49 is positioned within chamber 58 and is connected through terminal means 52 and 53 to line and to the apparatus to be protected. In this arrangement, conductive shields 54 and 56 are again generally cylindrical but one overlaps the other so that the spacing therebetween relative to the longitudinal axis of the housing is not axial as in the previously described embodiment, but is in a radial direction. Shield 54 is connected to one terminal 58 of the fuse by a pigtail 61. The shield 56 is connected to the opposite terminal 59 of the fuse by a pigtail 62.

It will be seen that when fuse 49 is in its on-line mode, the electrical stress occurs between shields 54 and 56 and conductive coating 57 on the exterior walls of housing 47. When the fuse is in its interrupted mode, shield 54 is at line potential whereas shield 56 will generally be at ground potential as is the conductive coating 57. Accordingly, the electrical stress is between shields 54 and 56 and between shield 54 and the outer coating 57. If the assembly is reversed so that terminal 59 is at line potential when interruption occurs, then shield 56 is at line potential and shield 54 at ground. Electrical stress is then between shield 56 and shield 54 and shield 56 and coating 57. Again, the entire shields are embedded wholly within the molded insulation material of the housing, with the exception of pigtails 61 and 62 which engage the terminals, and in both discussed connection conditions all voltage stress occurs across factory molded insulation so that corona can be adequately controlled. Again, the air space in chamber 48 between fuse 49 and the chamber walls is eliminated from the dielectric for effective control and for a minimum diameter on the entire overall assembly.

In both embodiments the shields are made of a carbon filled epoxy. One further advantage of the complete embedding of the shields in the molded insulation is that a wide variety of conducting materials can be used, i.e., from high impedance material to conductive metal.

Materials other than fiber glass thermo-set resins such as Rosite can be used for the housing. For example, an epoxy resin could be used in which case a voltage test point such as that disclosed in U.S. Pat. No. 3,343,153, and assigned to the assignee of this application, could be utilized to check for a blown fuse. Also, test points could be provided in elbow connections which are used with the housing and to check for a blown fuse.

Although this invention has been illustrated and described in connection with particular embodiments thereof, it will be apparent to those skilled in the art that various changes and modifications may be made therein without departing from the spirit of the invention or from the scope of the appended claims.

We claim:

1. Apparatus of the type described comprising in combination, a housing of electrical insulating material including means defining an interior chamber and means defining first and second spaced terminal means communicating with said chamber, an electrical device positioned in said chamber and connected to said terminal means, said electrical device completing an electrical circuit between said terminal means under normal circuit conditions and operative to interrupt said electrical circuit at a preselected abnormal circuit condition, first and second shields of electrically conductive material each electrically connected to a respective one of said terminal means, said shields positioned wholly within and completely surrounded by the material of said housing, and said first and second shields being spaced apart so that a closed electrical circuit between said first and second terminals does not exist through said shields, so that both when said electrical device completes and interrupts said electrical circuit all voltage stress occurs from said shields across the housing material and not from the electrical device and across any part of the chamber.

2. The apparatus of claim 1 wherein said apparatus is generally elongated and said shields include ends which, relative to the longitudinal axis of said apparatus, are spaced axially from each other.

3. The apparatus of claim 1 wherein said housing is formed by first and second portions joined along a generally radial plane, and said shields include ends which are positioned on opposite sides of said plane.

4. The apparatus of claim 3 including a gasket at said joint between said first and second housing portions, and wherein a portion of said gasket is positioned between the spaced ends of said shields forming a portion of the dielectric between said shield ends.

5. The apparatus of claim 4 wherein said housing is generally circular in transverse cross section and said shields are generally cylindrical.

6. The apparatus of claim 3 wherein said gasket includes a generally annular flange portion and a central body portion, and said central body portion closely engages the outer surface of said electrical device to divide the housing chamber into two portions and interrupts a direct path between said first and second terminal means along the walls of said chamber.

7. The apparatus of claim 6 including a plurality of spaced projections on said gasket body portion engaging said outer surface and defining limited openings on each side of each of said projections, said openings extending between the divided portions of said chamber.

8. The apparatus of claim 7 including vent means carried by said housing and operative to seal the chamber from the ambient under a preselected pressure condition and open said chamber to said ambient above said preselected pressure condition.

9. The apparatus of claim 8 wherein said vent means includes a movable seal and biasing means connected to said movable seal and biasing said movable member against said pressure in said chamber toward a sealed position.

10. The apparatus of claim 3 wherein said shields overlap and are spaced radially.

11. Apparatus of the type described comprising in combination, an elongated housing of electrical insulating material including means defining an interior chamber and means defining first and second spaced terminal means communicating with said chamber, an electrical device positioned in said chamber and connected to said terminal means, said electrical device completing an electrical circuit between said terminal means under normal circuit conditions and operative to interrupt said electrical circuit at a preselected abnormal circuit condition.

first and second shields of electrically conductive material each electrically connected to a respective one of said terminal means, said shields positioned wholly within and completely surrounded by the material of said housing, said housing being formed by first and second portions joined along a generally radial plane, said shields including ends positioned on opposite sides of said plane and spaced from each other, so that both when said electrical device completes and interrupts said electrical circuit all voltage stress occurs from said shields across the housing material and not from the electrical device and across any part of the chamber, a gasket positioned at said joint between said first and second housing portions with a portion of said gasket positioned between the spaced ends of said shields and forming a portion of the dielectric between said shield ends, and said first and second shields being spaced so that a closed electrical circuit between said first and second terminals does not exist through said shields but being closely adjacent so that dielectric flux lines fringe between said ends without substantial penetration into said chamber.

12. Apparatus of the type described comprising in combination, a housing including an interior chamber and first and second spaced terminal means communicating with said chamber, an electrical device positioned in said chamber and connected to said terminal means, said electrical device completing an electrical circuit between said terminal means under normal circuit conditions and operative to interrupt said electrical circuit at a preselected abnormal circuit condition, said housing being formed by first and second portions joined along a generally radial plane, a gasket at said joint between said first and second housing portions, said gasket includes a central body portion closely engaging the outer surface of said electrical device to divide the housing chamber into two portions and interrupting a direct path between said first and second terminal means along the walls of said chamber.

13. The apparatus of claim 12 wherein said gasket also includes a generally annular flange portion positioned in said joint between said housing halves.

14. The apparatus of claim 13 including a plurality of spaced projections on said gasket body portion engaging said outer surface and defining limited openings on each side of said projection, said openings extending between the divided portions of said chamber to permit gases to pass therebetween and equalize pressures on opposite sides of said gasket.

15. The apparatus of claim 14 including vent means carried by said housing and operative to seal the chamber from the ambient under a preselected pressure condition and open said chamber to said ambient above said preselected pressure condition.

16. The apparatus of claim 15 wherein said vent means includes a movable seal and biasing means connected to said movable and biasing said movable member toward said seal position and against said pressure in said chamber.

* * * * *